US006793020B2

(12) United States Patent
Courts

(10) Patent No.: US 6,793,020 B2
(45) Date of Patent: Sep. 21, 2004

(54) MECHANICAL TORQUE TABLE AND METHOD

(75) Inventor: Corey M. Courts, Youngsville, LA (US)

(73) Assignee: Specialty Rental Tool & Supply Co., Inc., Alvin, TX (US)

( * ) Notice: Subject to any disclaimer, the term of this patent is extended or adjusted under 35 U.S.C. 154(b) by 77 days.

(21) Appl. No.: 10/065,707

(22) Filed: Nov. 12, 2002

(65) Prior Publication Data

US 2003/0047319 A1 Mar. 13, 2003

Related U.S. Application Data

(60) Provisional application No. 60/319,191, filed on Apr. 16, 2002.

(51) Int. Cl.[7] ..... E21B 19/16

(52) U.S. Cl. ..... 166/379; 166/77.53; 166/78.1; 166/380

(58) Field of Search ..... 166/77.51, 77.53, 166/78.1, 85.1, 377, 380

(56) References Cited

U.S. PATENT DOCUMENTS 5,404,944 A * 4/1995 Lynde et al. ..... 166/117.7
6,003,412 A * 12/1999 Dlask et al. ..... 81/57.34
2002/0157823 A1 * 10/2002 Pietras et al. ..... 166/78.1

* cited by examiner

*Primary Examiner*—Zakiya Walker
(74) *Attorney, Agent, or Firm*—David B. Dickinson; H. Lee Huddleston, Jr.; Lundeen & Dickinson, LLP

(57) ABSTRACT

The present invention includes an apparatus and method to insert a small diameter pipe into a borehole while holding a larger diameter pipe. The apparatus includes a table attached to a centralized base which, in turn, provides a telescopic stop tower. The stop tower includes a force transducer that yields a readout when it is abutted by a first wrench when a second wrench secured to the small diameter pipe is turned.

16 Claims, 4 Drawing Sheets

MECHANICAL TORQUE TABLE AND METHOD

CROSS REFERENCE TO RELATED APPLICATIONS

This application claims the benefit of provisional application Ser. No. 60/319,191 filed on Apr. 16, 2002, incorporated herein by reference.

BACKGROUND OF INVENTION

The invention generally relates to tubular connecting devices for making and breaking connections in conventional threaded tubulars. More particularly, the invention relates to a mechanical torque testing apparatus and method for making up tubular connections to be inserted into the annulus of a large diameter tubular.

Tubular members, such as drill pipe, tubing pipe and casing used in oil and gas exploration and production are normally threaded together at their ends. Drillers have long known that the amount of torque applied in "making up" the joint is critical. Tubulars torqued at a sub-optimal level will not provide the necessary fluid tight seal across the made-up connection to allow the pipe to back-off in the annulus during drilling operations. When excessively torqued, the tubulars can result in costly damage to the connection members from stripped, or otherwise damaged threads. Furthermore, it is believed that over-torqued, and therefore over-stressed, tool joints can to lead to premature failure of the connections.

Additionally, because non-ferrous tubulars are increasingly being used in horizontal drilling operations, make-up torque problems can occur as a result of their differences in strength and various material properties with respect to traditional steel pipe. The rig worker that is in the practice of torquing various alloys and configurations of oilfield tubulars must be able to accurately apply a desired torque to each connection that is made-up. Merely "eye-balling" the amount of torque that is applied to a tubular connection is no longer a prudent practice among modern rig workers and reliable torque readings for each connection are important for such operations.

Traditionally, various devices and methods have been used to make-up and break-out threaded rotary connections in oilfield service. These prior-art methods include using the rotary table with pipe slips in conjunction with various pipe tong and top drive assemblies. Unfortunately, these systems utilize equipment that are bulky and difficult to manipulate and manage on a rig floor. Also, certain applications require the insertion of tubulars inside the bore or annulus portion of a drill stem or bottom hole assembly (BHA) to perform specialized tasks including, for example, sand packing a filter screen assembly. In order to perform these tasks, much smaller tubular components must be utilized to fit in the central bore of a drill string or into the annular space between the outer diameter of the drill string or BHA and the inner diameter of the well casing. These smaller tubulars require much less torque to properly make-up their connections so traditional means of torquing, for example, hydraulic tongs, produce torques too high to be used safely. Traditional means for dispensing torque are designed primarily for heavier duty tubulars such as drill string, and casing. As a result, there is a need in the industry for a torquing device and method that can accommodate smaller rotary tubular connections and dispense accurate torque loads thereto.

The apparatus of the present invention overcomes these problems by disclosing a compact system to be used to make-up and test the torque applied to a joint of small-diameter pipe on the rig floor all the while holding a larger diameter pipe to facilitate the insertion into the annulus thereof.

SUMMARY OF INVENTION

The present invention includes an apparatus for making up a smaller diameter tubular member by threading joints together to their recommended torque while securely and safely holding a larger diameter tubular or bottom hole assembly in rotary slips. An embodiment of the apparatus for connecting oilfield tubulars includes: a furcated or C-shaped base providing a longitudinal passage therethrough which may be moved on a rig floor over the upper end of a tubular or bottom hole assembly being held by the rotary slips; a longitudinally telescoping stop tower attached to the base which can act as a fulcrum for measuring the torque applied to a second tubular being inserted within the annulus or bore of the tubular or bottom hole assembly being held in the rotary slips: an adjustable plate connected to said base for centralizing a tubular or bottom hole assembly in the center of the longitudinal passage of the base; a stripping plate attached by an attached pipe collar to the top of said drill string; a bowl assembly set upon the stripping plate providing a means for holding a smaller diameter or second tubular in a set of pipe slips by seating in said bowl assembly; a torque arm releasably connected to the smaller diameter tubular being inserted in the drill string extending to a load cell mounted on the telescoping outrigger of the base, so that when torque is applied to the smaller diameter second tubular member, the torque may be readily determined by the operator on the rig floor.

BRIEF DESCRIPTION OF DRAWINGS

For a detailed description of the preferred embodiments of the invention, reference will now be made to the accompanying drawings in which.

DETAILED DESCRIPTION

One of the many possibilities for inserting a small diameter string into a larger string is to complete a sand filling operation. This is accomplished by inserting the smaller diameter tubular into the larger diameter bottom hole assembly and commence filing with sand while slowly withdrawing the smaller diameter tubular. Accordingly, it would be very important to properly make-up the threads of the smaller diameter pipe to its manufacturer's suggested torque to prevent it from disconnecting as it is manipulated and withdrawn. While the present embodiment can be used to insert a sand-pack tubular into a drill stem, it is not limited to this application. Many more applications may be readily accomplished by devices in accordance with the present invention without departing from the spirit of this disclosure.

Figure 1:
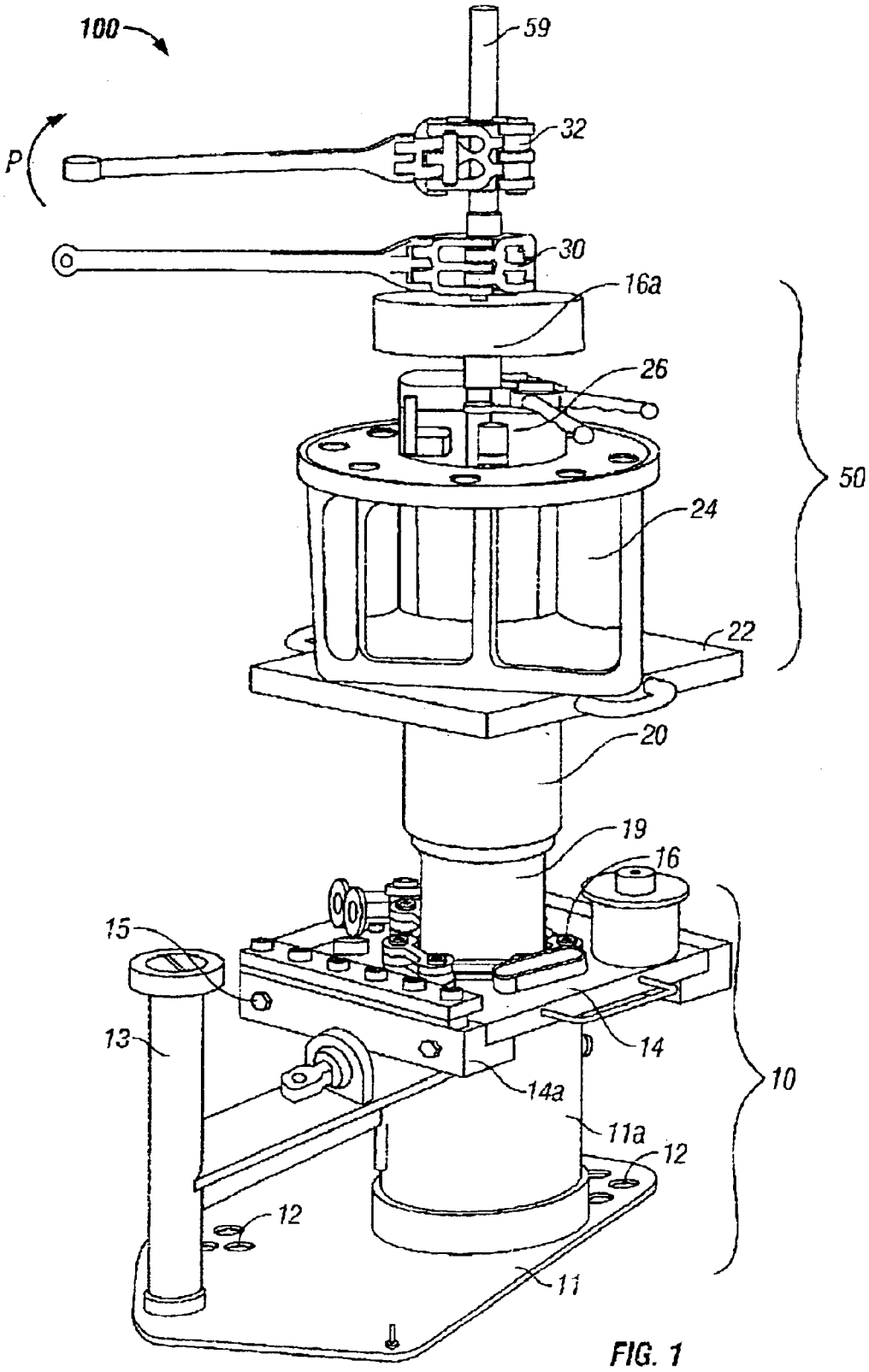
FIG. 1 is a perspective view drawing of a torque table assembly showing a telescoping stop tower in accordance with a preferred embodiment of the present invention.

Referring initially to FIG. 1, a preferred embodiment of a torque table assembly 100 is shown. Torque table assembly 100 is used to properly make-up a relatively small diameter tubular string 59 to be inserted within a larger diameter tubular string, or drill string, 19. Torque table assembly 100 includes a base assembly 10, shown retaining large diameter tubular 19 and a stripping platform assembly 50, shown mounted atop the retained tubular 19. When the drill string 19 is located at the desired depth, an operator secures string 19 in place using a "bowl" assembly with "slips" (not shown) and a rotary table (not shown) in a manner commonly known to those in the oil industry to prevent string 19 from moving relative to the axis of the borehole.

With large diameter drill string 19 secured in place, base assembly 10 is positioned about suspended string 19. Base assembly 10 includes a base plate 11, C-shaped body 11*a*, and a tubular telescoping stop tower 13. Assembly 10 is adapted to be placed on the rig floor and around secured string 19. Base plate 11 is configured to be secured to the rig floor with large pins or studs (not shown) through holes 12 provided on its periphery. C-shaped body 11*a* is configured as a ruggedized tube with an removed section (not visible) along its length to create a C-shaped cross section. Base plate 11 has a corresponding slot (not visible) cut in it to line up with removed section of body 11*a*. This configuration of plate 11 and C-shaped body 11*a* allows body 11*a* and plate 11 to be slid together around and enclose suspended string 19 without lifting.

With base assembly 10 located in place about suspended string 19, a segmented plate 14 is inserted into a receptacle 14*a* formed on the upper edge of C-shaped body 11*a* and is installed over suspended string 19. Each half of segmented plate 14 includes a cutout (not shown) that, when placed together in receptacle 14*a*, approximate the outer profile of string 19 and acts to centralize string 19 with respect to base assembly 10. As may be readily appreciated, segmented plate 14 may be modified with respect to size, profile, or configuration to provide an opening to enclose any size or configuration tubular or assembly desired without departing from the spirit or intent of this disclosure. Following installation into base assembly 10, halves of segmented plate 14 may be secured into place by installing and tightening cap screws 15 as shown. With base assembly 10 in position with string 19 properly centralized, string 19 can be clamped into place with an optional standard safety clamp 16 as a backup safety measure. Because the slips and rotary table discussed above act as the primary means for securing string 19 in place, safety clamp 16 is not a necessary component of the present invention.

Once string 19 is secured within base assembly 10, stripping platform assembly 50 is threaded into engagement with the top of string 19. Stripping platform assembly 50 includes a pipe collar 20, a stripping table 22, a bowl assembly 24, and a set of standard slips 26. The stripping platform assembly 50 is secured to the top of string 19 through the use of pipe collar 20.

Pipe collar 20 can be of any configuration as long as it is constructed to mate appropriately with the tool joint (not visible) at the top of string 19. For example, pipe collar 20 can be configured to be a standard oilfield "pin" or "box" connection and can be of any standard oilfield rotary thread designation. Pipe collar 20 can be of a non-threaded rotary connection, as long as pipe collar 20 is designed to transfer loads to string 19 as would be experienced downhole when properly made-up.

Pipe collar 20 is then connected to stripping table 22 through conventional means. While pipe collar 20 can be welded directly to stripping table, it should be understood that one aspect of the preferred embodiment of the present invention is that one stripping table 22 can be used with pipe collars 20 to accommodate various sizes and configurations of pipe strings 19. To accomplish this, a releasable configuration commonly known in the art (threaded engagement, snap rings, dowel pins, etc.), may be employed to allow the combination of any given pipe collar 20 with stripping table 22.

Mounted to stripping table 22 is bowl assembly 24. Bowl assembly 24 is preferably constructed as a typical "off-the-shelf" component, similar to those used in rotary tables to secure drill pipe with slips. Depending on the amount and direction of loads expected to be experienced by small diameter string 59, Bowl assembly 24 can be rigidly affixed atop stripping table 22 or can be held in place the weight of string 59 and its own weight. If it is desired to be rigidly affixed to stripping table 22, bowl 24 can be attached via standard bolts or through welding. Bowl assembly 24 provides a plurality of wedge-shaped slips 26, that are used to secure small diameter string 59 in place, thus restricting axial movement of string 59. Slips 26 are also standard "off-the-shelf" items that are often matched with bowl 24 to ideally fit a particular size of string 59 therethrough. The wedge shape design of slips 26 (and corresponding bowl 24) allows for the grip on string 59 to be increased with increases in downward tension on the string. Further, as described above in reference to base assembly 10, a second safety clamp 16*a* can be attached to the small diameter string 59 above bowl 24 and slips 26 to prevent axial displacement but does not affect the operation of the present invention.

Figure 4:
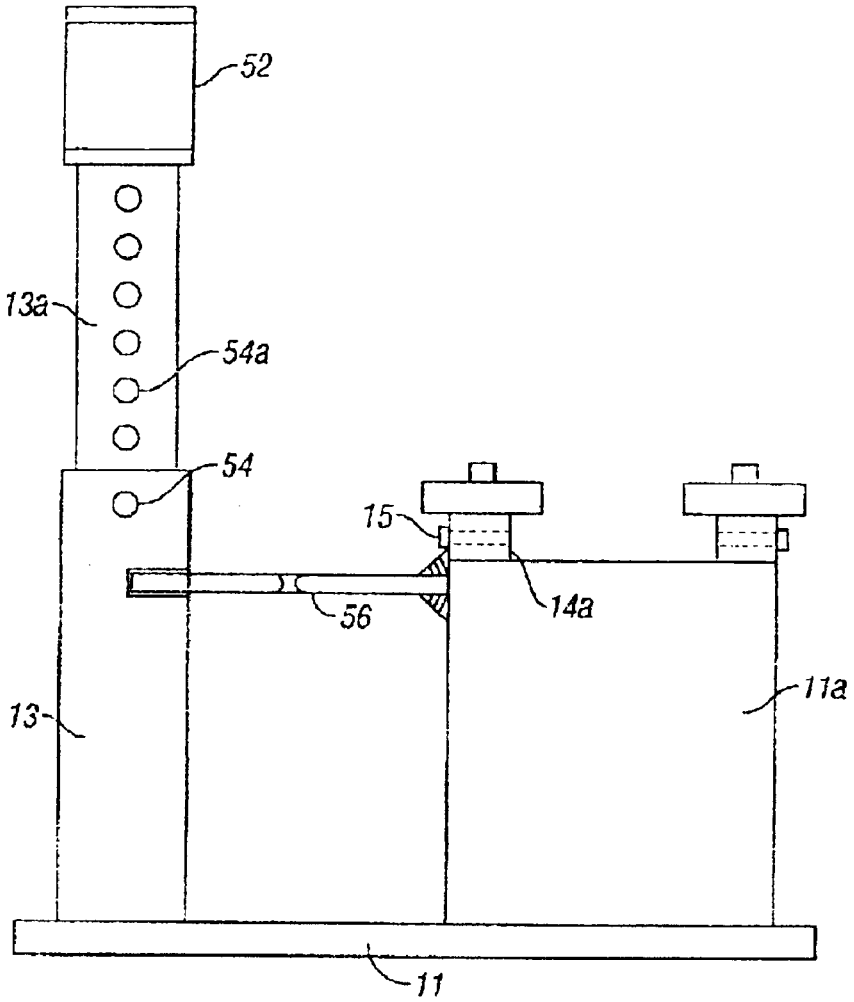
FIG. 4 is a schematic drawing of the telescoping stop tower of FIGS. 1–3.

With smaller 59 and larger 19 strings secured in place within vase assembly 10 and stripping platform assembly 50, telescoping stop tower can now be extended. Referring now to FIG. 4, telescoping stop tower 13 is preferably rigidly secured at its bottom to base plate 11 and along its length to C-shaped body 11*a* by brace 56. In order to maximize rigidity and strength, it is preferred that stop tower 13 be welded to brace 56 and plate 11, although other attachment mechanisms are certainly viable. Stop tower 13 is preferably constructed of a cylindrical tube approximately 33" in height and preferably includes a hole 54 through the wall to accept a shear pin (not shown) therethrough. It should be understood that other heights and configurations of stop tower 13 may be utilized without departing from the spirit of the invention.

Stop tower 13 preferably includes a concentric telescopic member 13*a* housed within its tubular wall. Telescopic member 13*a* includes a plurality of apertures 54*a* that are designed to align with dowel hole 54 and accept a shear pin (not shown) to adjust the combined height of stop tower 13 and telescopic member 13*a* to a desired height. It Is to be understood that if a fixed height is desired, a single stop tower 13 may be constructed to a pre-determined height.

Preferably mounted to the top of telescopic member 13*a* is a load measurement device 52. Load measurement cell may be of any number of configurations as long as it is capable of relaying to an operator of the torque table assembly 100, the amount of load placed thereupon. As such, measurement cell 52 may be an analog or digital transducer of may display that force either by means of an analog dial or a digital readout. Furthermore, measurement cell may be calibrated to display or transmit amount of force or torque applied.

Figure 2:
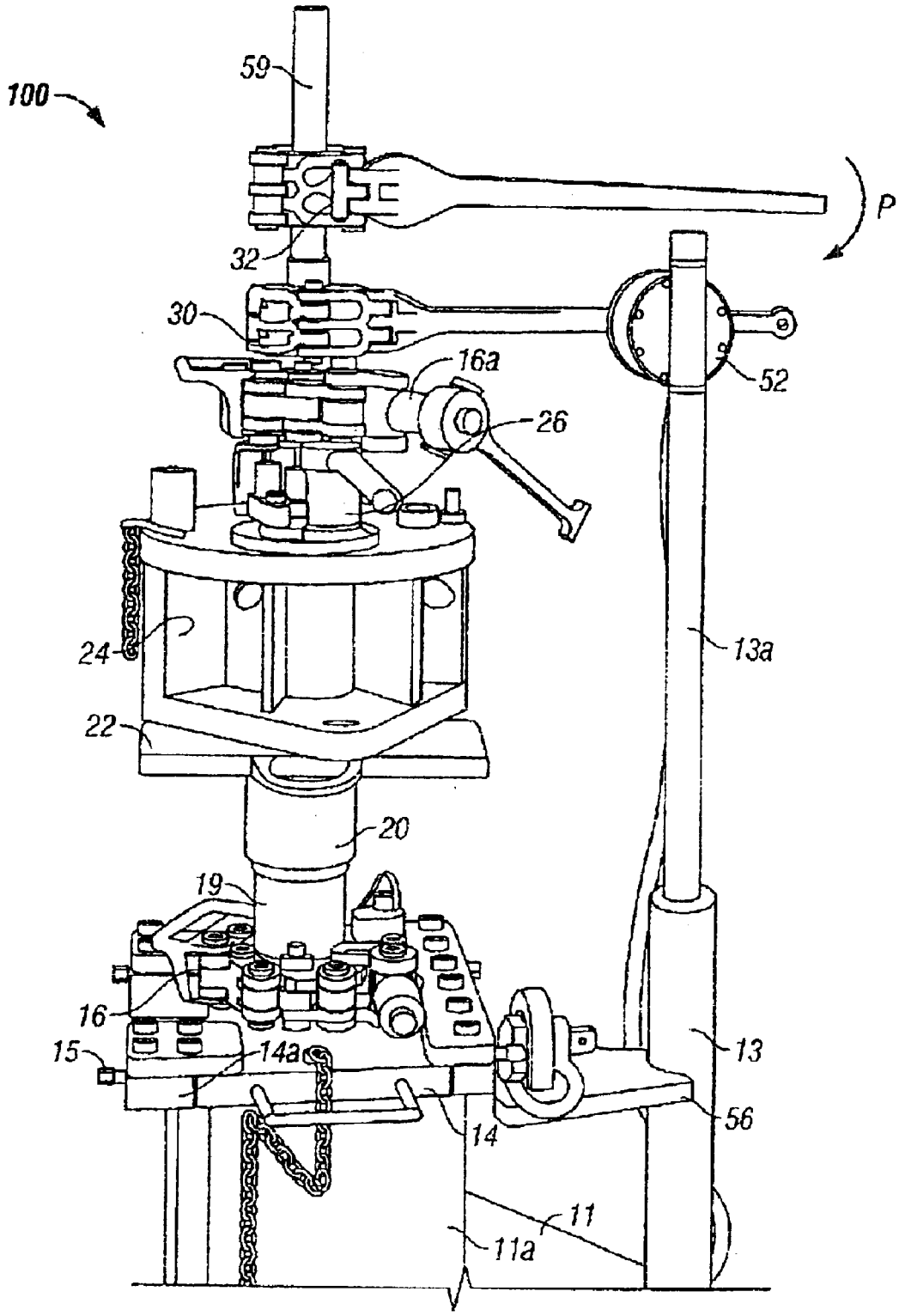
FIG. 2 is another perspective view drawing of the assembly of FIG. 1 showing the telescoping stop tower in an extended position.
Figure 3:
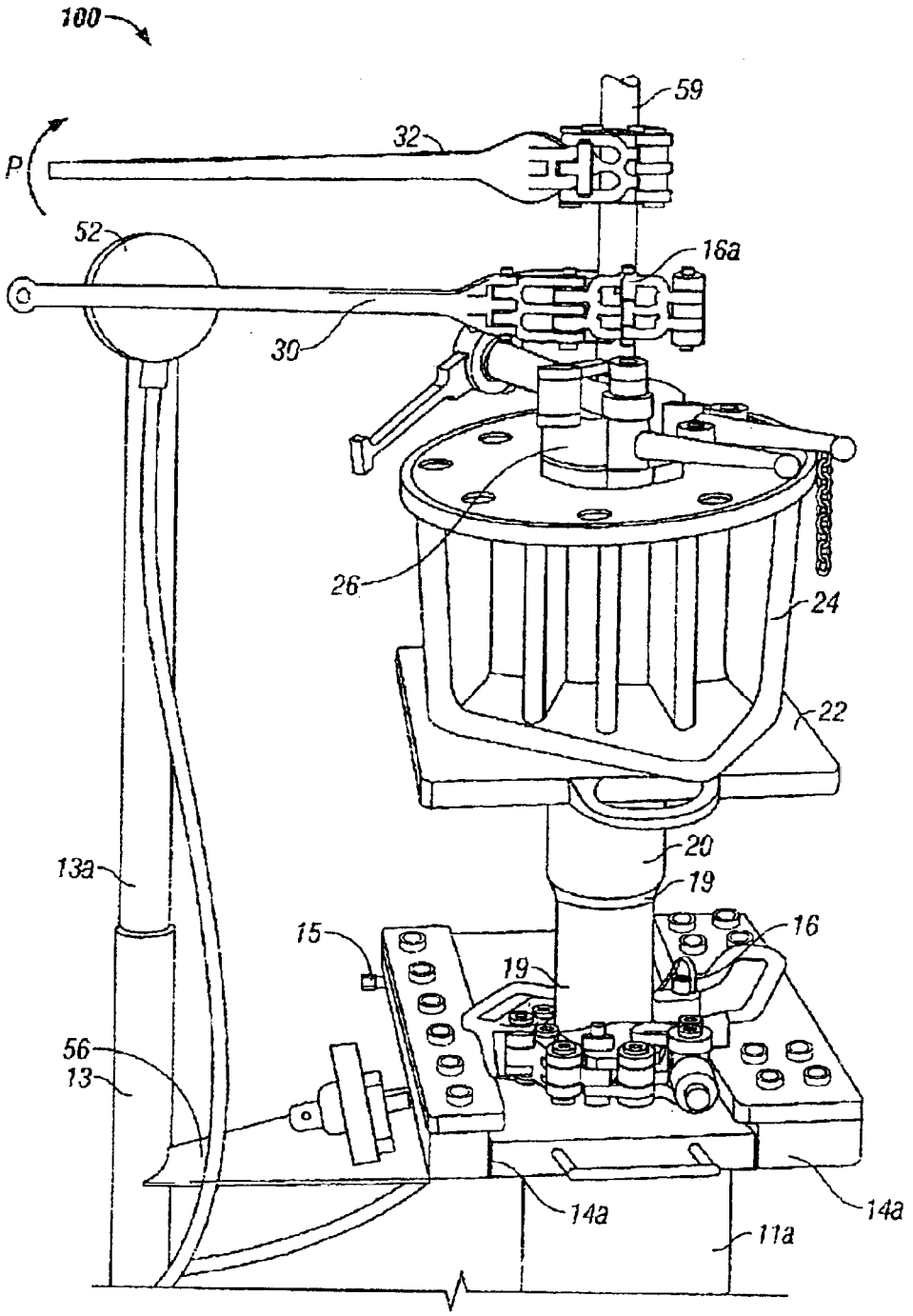
FIG. 3 is an perspective view drawing of the assembly of FIG. 2 in shown from an alternative angle.

Referring now to FIGS. 2–3, the method for using the torque table assembly 100 can be described. To make up a string of small diameter tubing 59 within a string of larger diameter drill pipe 19 the following steps must be performed. First, the string of drill pipe 19 must be secured into the rotary table using the bowl and slips (not shown) as is well known in the art. Then base assembly 10 is positioned around string 19 such that string 19 is generally concentric with C-shaped body 11*a*. Once base assembly 10 is positioned property, base plate 11 is secured to the rig floor or rotary table using securing holes 12. Next, segmented plate 14 is inserted into receptacle 14*a* at the top of body 11*a* and secured with cap screws 15 to properly centralize string 19. Next optional clamp 16 is installed If desired, or required by code, to further restrict axial movement of string 19.

Next, rig workers separate top of string 19 from pipe drive assembly (not shown) if not already done. With string 19 disconnected from above, operator is free to insert smaller diameter string 59 into the inner diameter of pipe string 19. To properly torque mating sections of smaller diameter string 59, operator first positions end of first string high enough above the top of string 19 to clear stripping platform assembly 50. Stripping platform assembly 50 is then installed by threading pipe collar 20, either with table 22 attached or detached, into the top tool joint of string 19. Once threaded in, operator then adds table 22, bowl 24, and slips 26, if not already attached to collar 20. Operator then performs the necessary steps (known to those skilled in the art) to secure and "hang" the small diameter string 59 with slips 26 and bowl 24. Again, if operator desires, or if code requires, secondary clamp 16*a* is then secured to restrict axial movement of string 19. If set up properly, the threaded joint of string 59 that is to be torqued (or, in the instances of disassembly, un-torqued) will be positioned above the slips 26, or clamp 16*a* (if installed) by approximately 8–10 inches.

With torque table properly set up as above, operator then extends telescopic member 13*a* and secures it in place with shear pin (not shown). The ideal height for telescopic member 13*a* is the height at which measurement cell 52 lines up with the bottom half of the tool joint of string 59 to be tightened. With Tower (13 & 13*a*) in position, operator then attaches a first pipe wrench 30 to the outer diameter of string 59 below the tool joint that is to be torqued as shown. First pipe wrench is positioned such that the butt of its handle contacts the load surface of measurement cell 52 in a direction such that as the joint of string 59 is torqued, the resistance of wrench 30 is transmitted fully to cell 52. With first wrench 30 in position, operator then attaches second pipe wrench 32 to small diameter string 59 above the tool joint to be torqued and applies make-up torque In direction "P" to the top component of tool joint. As joint of string 59 is made-up, load to wrench 32, load P is transmitted, through the tool joint, to first wrench 30 and subsequently to measurement cell 52. Telescopic tower (13 and 13*a*) acts as a fulcrum to both enable operator to apply and measure torque applied to tool joint of string 59. Using the readout of cell 52, whether digital or analog, operator can accurately monitor the amount of make-up torque he or she applies to tool joint of string 59, thus preventing over or under torquing the joint. Because the distance from the center of small diameter string 59 to the center of load cell 52 is known and fixed, an operator can easily convert the force measured by cell 52 to torque applied to the tool joint. Further, with computers and digital gauges, such conversions, as well as factors like friction, and other design-specific joint characteristics, can be done without any interaction with the operator, thereby producing a highly accurate "torque applied" reading.

Once the connection is made, the operator can lift the smaller diameter string 59 off slips 26 and remove them in a manner well known to those in the drilling industry. String 59 can then be lowered to a depth that allows the next joint of small diameter string 59 to be made up in a similar fashion. This process continues until the entire string of smaller diameter pipe is made up. Once the complete length of assembled string 59 is made up and moved into the hole the sand-packing (or other specialized job) can be accomplished.

To remove the small diameter string, the operator performs the assembly procedure in reverse. The operator lifts the smaller diameter pipe until a joint is immediately above the bowl 24 on the stripping plate 22. The slips 26 are set as the operator sets the smaller diameter pipe 59 down on the slips. The operator then can disconnect the upper pipe assembly from that portion which remains in the well bore. After the disassembly of small diameter string 59, stripping plate 22 and collar 20 are unthreaded from larger diameter drill pipe 19 still being held by the slips.

Even though the embodiment disclosed teaches an apparatus and method for assembling and torquing a small diameter string of tubulars within the bore of a larger diameter of tubulars, the embodiment is capable of being modified by one skilled in the art to allow the installation of smaller diameter tubulars into the annulus formed between a primary string of tubulars and the borehole wall of a subterranean well. To accomplish this goal, the stripping platform assembly 50 could be relocated to a position atop the C-shaped body 11*a* offset from the clearance hold for tool string 19. As such smaller diameter string 59 could be injected into the annulus of the well by holding string 19 centralized within lower base assembly 10 while the smaller string 59 is allowed to enter the annulus at a slight angle.

While a preferred embodiment of the invention has been shown and described, modifications thereof can be made by one skilled in the art without departing from the spirit of the invention.

What is claimed is:

1. A torque table apparatus for installing a secondary string of tubulars into a borehole, the torque table apparatus comprising:

a base assembly to centralize and retain a primary string of tubulars;

a stripping table to position and retain the secondary string of tubulars;

said stripping table positioned with relation to said base assembly in order to define a preferred relationship between said primary string and the secondary string of tubulars;

said base assembly including a stop tower assembly, said stop tower including a load cell;

a first wrench to grip the secondary string below a tool joint of interest, said first wrench configured to abut said load cell;

a second wrench to grip the secondary string above said tool joint of interest, said second wrench configured to apply torque to said tool joint of interest when said second wrench is moved relative to said first wrench in a make-up direction; and said load cell configured to display a reading as said second wrench is moved in said make-up direction.

2. The torque table apparatus of claim 1 wherein said load cell is a digital device.

3. The torque table apparatus of claim 2 wherein said digital device is configured to display a calibrated torque number for any given force applied thereon.

4. The torque table apparatus of claim 1 wherein said load cell is an analog device.

5. The torque table apparatus of claim 1 wherein the stop tower assembly is retractable.

6. The torque table apparatus of claim 5 wherein the height of the stop tower assembly is adjustable.

7. The torque table apparatus of claim 1 wherein said preferred relationship includes the secondary string disposed within a central bore of said primary string.

8. The torque table apparatus of claim 7 wherein said stripping table is connected atop a primary tool joint of said primary string of tubulars.

9. The torque table apparatus of claim 1 wherein said preferred relationship includes the secondary string disposed within an annulus defined between said primary string and the borehole.

10. The torque table apparatus of claim 9 wherein said stripping table is connected to said base assembly adjacent to said primary string of tubulars.

11. The torque table apparatus of claim 1 wherein said stripping table includes a bowl and slip assembly to secure the secondary string of tubulars.

12. The torque table apparatus of claim 1 wherein said base assembly includes a C-shaped body to enclose and centralize said primary string of tubulars.

13. A method for torquing a secondary string of tubulars for deployment into a wellbore, the method comprising the steps of:

securing a primary string of tubulars to prevent axial and radial movement thereof;

installing a torque table assembly around the primary string, the torque table assembly configured to position the secondary string with respect the primary string in a preferred arrangement, and provide a stop tower for torquing the secondary string;

attaching a first wrench to the secondary string, the first wrench configured to abut a load cell attached to the stop tower, the first wrench positioned below a tool joint of interest;

engaging a second wrench with the secondary string, the second wrench positioned above the tool joint of interest and configured to increase torque in the tool joint of interest as the second wrench is rotated relative to the first wrench; and rotating the second wrench with respect to the first wrench until a desired reading is displayed upon the load cell.

14. A method for torquing a secondary string of tubulars into a wellbore, the method comprising the steps of:

securing a primary string of tubulars to prevent axial and radial movement therof;

placing a base assembly around the primary string, the base assembly configured to hold the primary string in a radial position;

attaching a stripping table to the base assembly, the stripping table configured in a relative position with respect to the primary string, the relative position defining a downhole relationship between the primary string and the secondary string;

hanging the secondary string of tubulars in the stripping table, the stripping table further configured to selectively restrict axial movement of the secondary string;

attaching a first wrench to the secondary string, the first wrench configured to abut a load cell attached to a stop tower, and the first wrench positioned below a tool joint of interest;

engaging a second wrench with the secondary string, the second wrench positioned above the tool joint of interest and configured to increase torque in the tool joint of interest as the second wrench is rotated relative to the first wrench; and rotating the second wrench with respect to the first wrench until a desired reading is displayed upon the load cell.

15. An apparatus for connecting oilfield tubulars, the apparatus comprising:

a base providing a longitudinal passage therethrough;

a longitudinally telescoping stop tower attached to said base;

a table attached to said base providing an adjustable plate for centralizing a first tubular in said longitudinal passage of said base;

said first tubular having a bore therethrough;

a stripping plate having an aperture therethrough, said stripping plate attached to the top of said first tubular;

a bowl assembly disposed on said stripping plate;

a pipe slip seated in said bowl assembly engaging a second tubular for insertion into said bore;

a torque arm releasably attached to said second tubular and engaging a load cell mesial the distal end of the torque arm;

a telescoping stop tower for measuring torque applied to the second tubular; and a tong releasably attached adjacent the torque arm for applying torque to the second tubular.

16. A method for holding a first tubular while connecting a second tubular to a specified torque for insertion in the annulus of said first tubular comprising:

centralizing a first tubular below a plate;

restraining a second tubular from movement by compressive engagement on a table attached to said first tubular;

holding a load cell laterally adjacent the second tubular by attaching to a fixed telescoping member;

extending a torque arm from said second tubular to said load cell; and applying torque to said second tubular attached adjacent said torque arm to a predetermined amount.

* * * * *